US005493496A

United States Patent [19]

James et al.

[11] Patent Number: 5,493,496

[45] Date of Patent: Feb. 20, 1996

[54] CYLINDER NUMBER IDENTIFICATION ON A DISTRIBUTORLESS IGNITION SYSTEM ENGINE LACKING CID

[75] Inventors: John V. James, Walled Lake; James M. Dosdall, Grosse Ile, both of, Mich.

[73] Assignee: Ford Motor Company, Dearborn, Mich.

[21] Appl. No.: 991,027

[22] Filed: Dec. 15, 1992

[51] Int. Cl.[6] ..... G06G 7/70; F02P 17/00; F02P 3/06

[52] U.S. Cl. ..... 364/431.04; 364/431.09; 123/418; 123/643; 123/424; 123/414; 123/335; 123/602; 123/415; 123/427; 123/634; 123/621; 73/115; 73/118.1; 324/380; 324/402; 324/379; 324/384; 324/399

[58] Field of Search ..... 364/431.04, 431.03, 364/431.05, 431.06; 123/643, 644, 414, 475, 612, 617, 609, 635, 634, 620, 647, 491, 424, 418, 427, 621, 335, 602, 417; 73/116, 117–118; 324/379, 399, 402

[56] References Cited

U.S. PATENT DOCUMENTS

| | | | |
|---|---|---|---|
| Re. 34,183 | 2/1993 | Wilens et al. | 123/417 |
| 3,882,835 | 5/1975 | Randriamanentena | 123/418 |
| 4,379,263 | 4/1983 | Everett et al. | 324/379 |
| 4,543,936 | 10/1985 | Gardner et al. | 123/475 |
| 4,627,398 | 12/1986 | Koike | 123/427 |
| 4,627,407 | 12/1986 | Betz | 123/634 |
| 4,711,227 | 12/1987 | Li et al. | 123/643 |
| 4,742,306 | 5/1988 | Everett et al. | 324/379 |
| 4,795,979 | 1/1989 | Kreft et al. | 324/379 |
| 4,847,563 | 7/1989 | Sniegowski et al. | 324/402 |
| 4,889,094 | 12/1989 | Beyer et al. | 123/414 |
| 4,899,579 | 2/1990 | Sweppy et al. | 73/118.1 |
| 4,937,527 | 6/1990 | Sniegowski et al. | 324/402 |
| 4,941,445 | 7/1990 | Deutsch | 123/414 |
| 5,045,796 | 9/1991 | Bentel et al. | 324/399 |
| 5,065,729 | 11/1991 | Krauter et al. | 123/643 |
| 5,067,462 | 11/1991 | Iwata et al. | 123/414 |
| 5,088,465 | 2/1992 | Debiasi et al. | 123/431 |
| 5,090,394 | 2/1992 | Bruckelt et al. | 123/643 |
| 5,109,828 | 5/1992 | Tagami et al. | 123/635 |
| 5,115,793 | 5/1992 | Giaccardi et al. | 123/620 |
| 5,125,386 | 6/1992 | De Filippis et al. | 123/634 |
| 5,174,267 | 12/1992 | DeBiasi | 123/643 |
| 5,186,144 | 2/1993 | Fukui | 123/414 |

FOREIGN PATENT DOCUMENTS

| | | |
|---|---|---|
| 0508804 | 4/1992 | European Pat. Off. . |
| 4018895 | 7/1991 | Germany . |
| 4028554 | 3/1992 | Germany . |

*Primary Examiner*—Kevin J. Teska
*Assistant Examiner*—Jacques H. Louis-Jacques
*Attorney, Agent, or Firm*—Mark L. Mollon; Roger L. May

[57] ABSTRACT

An apparatus for identifying the power stroke of a particular cylinder in a multi-cylinder engine which utilizes a wasted spark electronic distributorless ignition system but lacks a camshaft driven cylinder identification sensor, wherein a single sensor can be placed in a coil pack adjacent to and substantially equidistant from the ignition coil towers. The sensor will produce a signal reflecting the difference in voltage drops between corresponding pairs of spark plugs who share the same coil and which utilizes this signal to determine the power stroke of individual cylinders to produce a resulting synthetic cylinder identification signal. This apparatus can further be used as a permanent on-board sensor, thereby negating the need for a separate camshaft driven sensor, to determine the cylinder identification.

19 Claims, 6 Drawing Sheets

CYLINDER NUMBER IDENTIFICATION ON A DISTRIBUTORLESS IGNITION SYSTEM ENGINE LACKING CID

TECHNICAL FIELD

This invention relates to an apparatus for determining cylinder identification on distributorless ignition system engines built without camshaft driven CID sensors, for the purpose of engine analysis and diagnostics by on-board or external equipment.

BACKGROUND ART

In more traditional four cycle engines using conventional distributors, the cylinder identification was easy to accomplish since each spark plug fired only once per complete engine cycle. Thus, off-board engine diagnostics equipment would only need a single lead sensing the firing of the number one cylinder in order to determine the engine rotational position. In the current distributorless wasted spark systems, however, the spark plug in a cylinder will fire twice per complete engine cycle, which corresponds to two crankshaft rotations per cycle. Therefore, the existing off-board diagnostics equipment could not distinguish in which half of the engine cycle the spark was firing for a particular cylinder. The plug firings that occur during the half of the engine cycle producing combustion are termed the power stroke, while those occurring on the exhaust stroke are termed wasted stroke. The terms power stroke and wasted stroke used herein are merely a convenient way to distinguish the combustion half of the engine cycle, comprising the compression stroke and power stroke, from the exhaust half of the engine cycle, comprising the exhaust stroke and intake stroke.

The most direct way to solve this ambiguity, is to mount a sensor to the engine which can determine the rotational position of a camshaft, thus determining which half of the engine cycle the engine is in at all times. Currently, nevertheless, many distributorless ignition systems using the wasted spark method, do not employ a camshaft driven sensor to determine the exact rotational position of the engine. While this is sufficient for conventional engine operation, it does not provide sufficient information for engine diagnostics or more advanced engine operation, such as sequential fuel injection systems. Accordingly, for the purpose of engine analysis and diagnostics for wasted spark systems without CID sensors, an off-board apparatus is needed that can determine which half of the cycle the engine is in. And furthermore, an on-board apparatus is needed that could be inexpensively built into the engine system, thereby eliminating the need for an additional expensive camshaft driven sensor.

More recently, off-board engine diagnostics equipment has been developed with the ability to determine when a cylinder firing event is associated with the beginning of a power stroke rather than a wasted spark firing. Most notably, systems have been developed which can separately measure the voltage drops and calculate the difference in magnitudes of voltage drops, called the breakdown voltage, across pairs of spark plugs connected to opposite ends of the same coil. These corresponding spark plugs are disposed in cylinders which are one half phase apart, i.e., 360° out of phase with one another. This measurement is useful because the voltage drop is larger on the cylinder entering its power stroke than it is on the corresponding cylinder which experiences a wasted spark firing. Up until now, this has been accomplished by using multiple sensors connected to the ignition cables, running between the spark plugs and coils, which transmits the data to a microprocessor that must sort and process these signals. This requires significant computing power in that each cylinder produces signals that are sent to the microprocessor, and these individual signals are then added together electronically to determine which of the two firing events produce a greater voltage drop, before further processing of this information can be done to determine which cylinder was entering its power stroke. Additionally, this type of system takes significant time to hook up since several sensors must be installed.

Also, more recently, some engines require on-board capability of determining the cylinder identification, particularly those using sequential fuel injection. This is currently accomplished using a camshaft driven sensor which directly detects the rotation of a camshaft. These sensors can be quite expensive to add to the current engine systems.

SUMMARY OF THE INVENTION

An object of this invention is to provide a reliable method for determining the cylinder identification in a wasted spark distributorless ignition system lacking a cylinder identification sensor, thereby allowing for engine diagnostics.

Another object of this invention is to accomplish the above-mentioned object using a minimum of sensors, thereby reducing the information that must be processed by a microprocessor, while still providing reliable information even if some spark plugs are not operating properly.

A method of this invention contemplates identifying the power stroke of individual cylinders, and thereby unique cylinder number identification, in a multi-cylinder four cycle engine with a wasted spark electronic distributorless ignition system having at least two ignition coils each coupled to two different spark plugs. The engine is able to sense crankshaft location based on a crankshaft sensor used in producing a profile ignition pick-up (PIP) signal and primary coil signals but lacking a camshaft driven cylinder identification sensor. The method is accomplished by providing a conductor adjacent to and substantially equidistant from each pair of secondary coil outputs of the ignition coils, to generate an induced voltage difference signal during each coil firing event. Then, analyzing the induced voltage difference signals, the PIP signal and the primary coil signal to determine which cylinder, associated with one of the pairs of spark plugs, was entering its power stroke.

While this method will work when only sensing voltage drops for two cylinders, the accuracy and reliability is increased when employing the redundancy of sensing the voltage drops for each pair of cylinders, since each pair fires out of phase with one another. These separate firing events can be combined and analyzed together, thus producing usable results even if one coil or spark plug fails.

A further object of this invention is to provide a capability to continuously determine the cylinder identification on a wasted spark distributorless ignition system built into production engines, thus eliminating the need for an on-board camshaft driven sensor by providing an economical alternative.

BEST MODE FOR CARRYING OUT THE INVENTION

Figure 1:
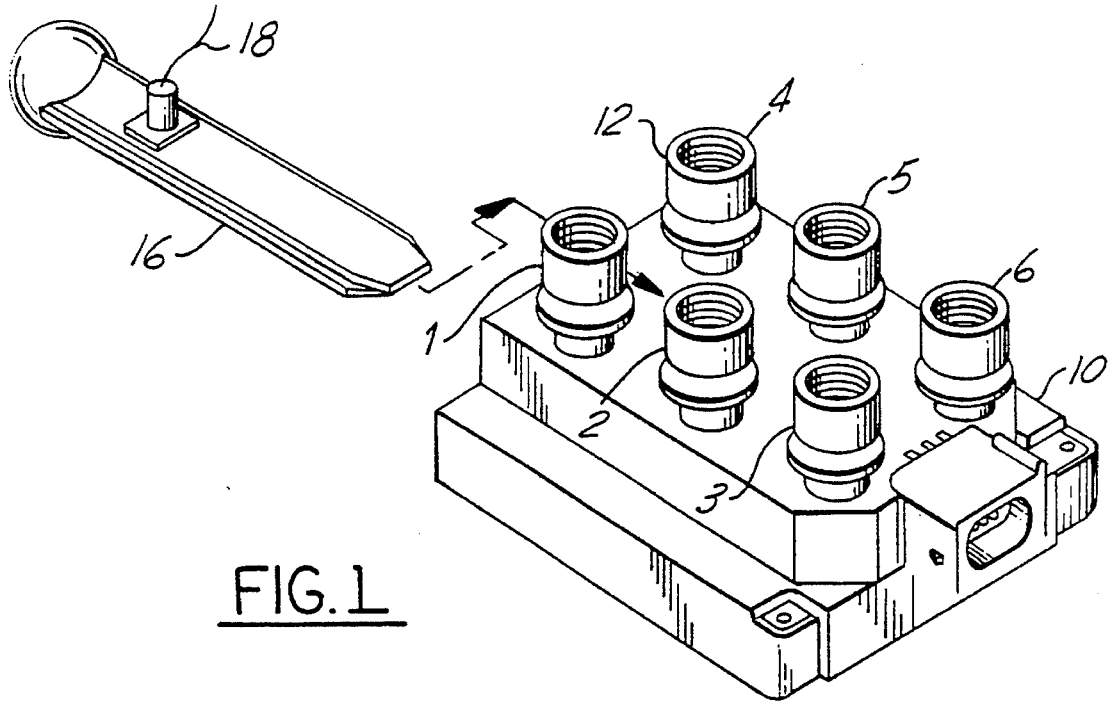
FIG. 1 is a perspective view of a six-tower ignition coil assembly and a coil sensor.
Figure 3:
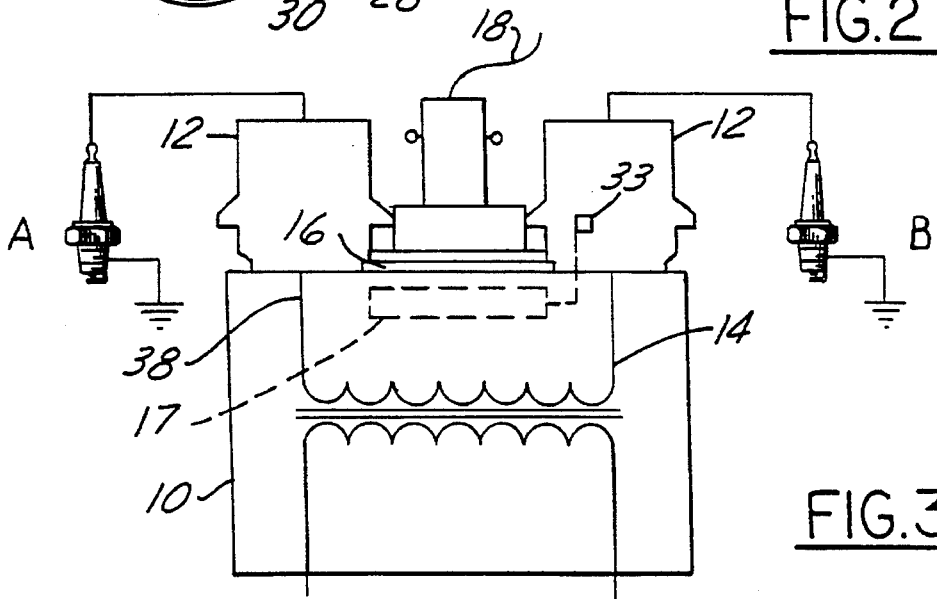
FIG. 3 is a schematic diagram showing a side view of the coil pack with the sensor in place and spark plugs, in accordance with the present invention.

FIGS. 1 and 3 show a coil pack 10 for a six cylinder, four cycle engine with a wasted spark electronic distributorless ignition system, not shown. Mounted to the coil pack 10 are six ignition coil towers 12, each coil tower connected, through ignition coil secondary outputs 38, to one of three coils 14 and also electrically connected to its respective spark plug. The ignition towers 12 are electrically connected in pairs across the coils 14 such that ignition towers 12, whose corresponding spark plugs are in cylinders which are 360 degrees out of phase with one another, are connected to opposite leads of the same coil 14. In this example, shown in FIG. 1, the firing order is 1-4-2-5-3-6, with the plugs in pairs such that cylinders 1 and 5; 2 and 6; and 3 and 4; share the same coil, respectively. This configuration will also work equally as well if the coils 14 are mounted side by side rather than mounted within a coil pack 10.

Figure 6:
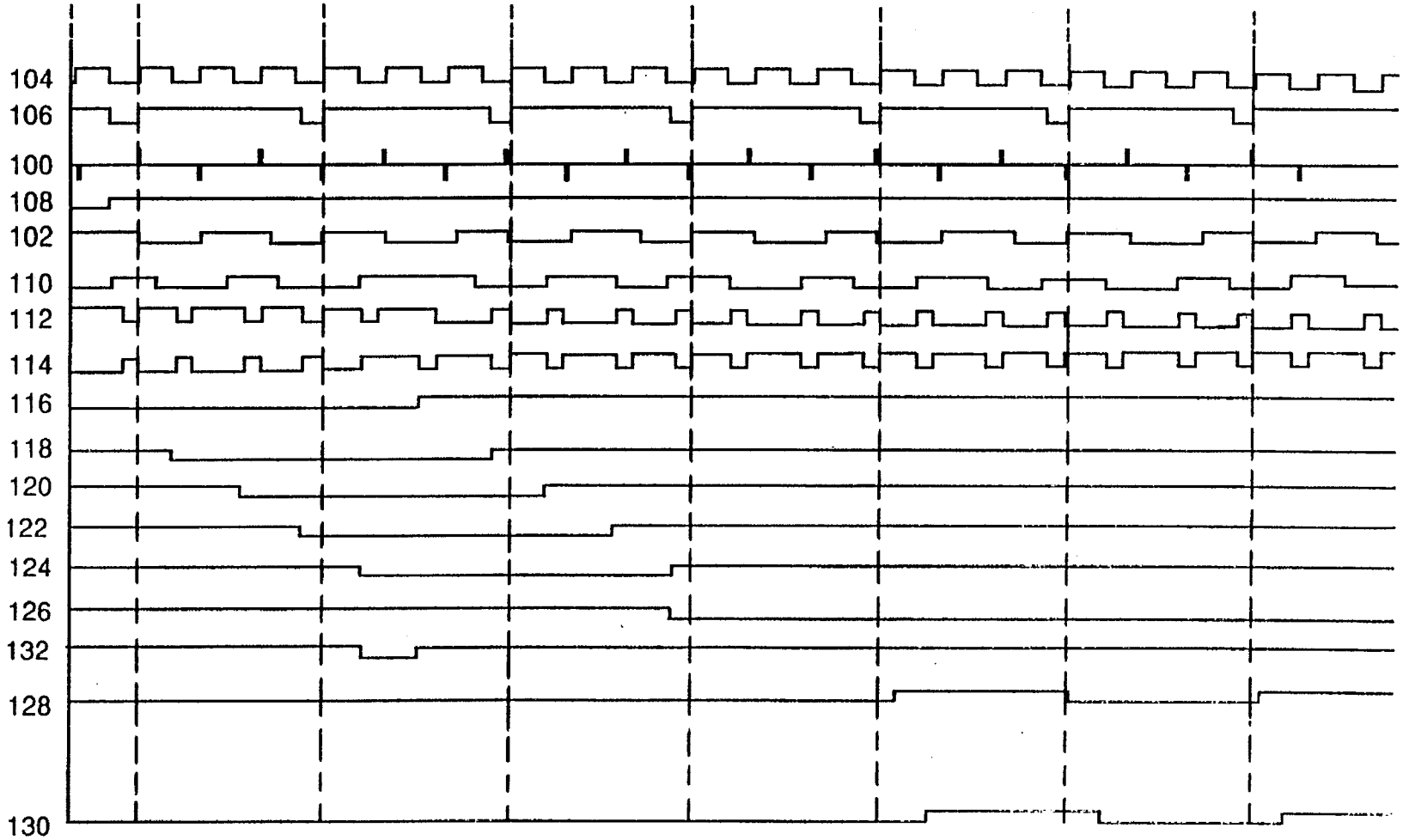
FIG. 6 is a graphical representation of signal sampling of various control signals generated by the embodiment shown in FIG. 4 when the random guess of the engine phase is incorrect, in accordance with the present invention.
Figure 7:
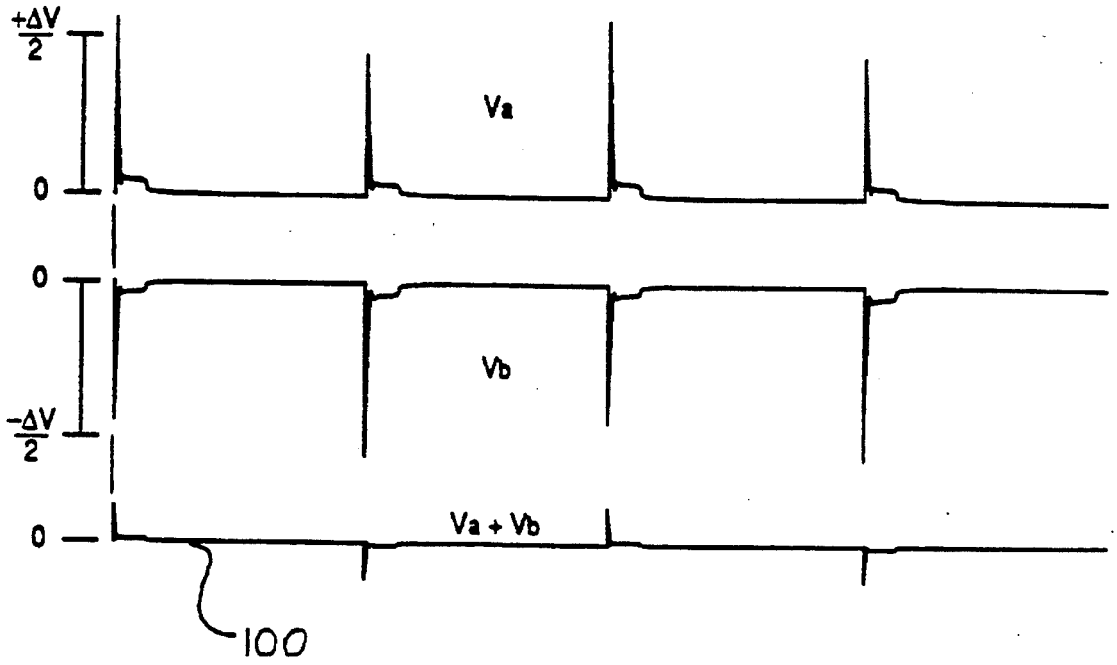
FIG. 7 is a graphical representation of signal sampling of the voltage drops and the difference between voltage drops for a pair of spark plugs sharing the same ignition coil, in accordance with the present invention.

Referring now to FIGS. 1 and 7, since the spark plugs A, B of both corresponding cylinders are in series, the same current passes through each. Also, both have a common ground, i.e. the engine block. The total voltage drop across this coil $\Delta V$, therefore, is divided between the two corresponding spark plugs A, B. $V_a$ is the voltage drop across spark plug A, while $V_b$ is the voltage drop across spark plug B. These two voltage drops, $V_a$, $V_b$, are not the same magnitude due in large part to the fact that the combustion chamber pressures of the two corresponding cylinders are vastly different. The spark plug in the cylinder under pressure creates a voltage drop of larger magnitude, and opposite polarity with respect to ground, than the other plug. The sum $V_a+V_b$, therefore, of these two voltage drops will show which plug produced the larger of the two. By capacitively coupling a spark sensor 16 between the coil towers 12, this spark sensor 16 will capacitively sense the resultant sum of the voltage drops between each corresponding pair of spark plugs and produce an analog induced voltage difference signal 100, shown in FIGS. 5, 6, and 7.

Figure 2:
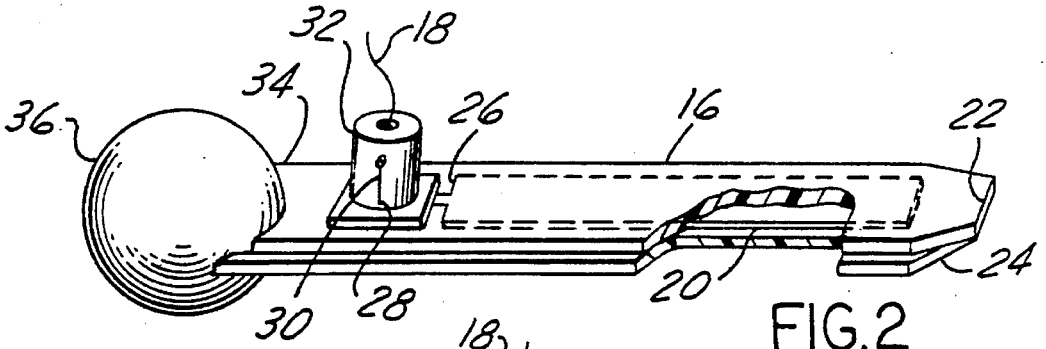
FIG. 2 is a perspective view in partial section showing the sensor, in accordance with the present invention.

A first embodiment of the invention is shown in FIGS. 1 and 2. Here, the spark sensor 16 is shown as an external diagnostics tool, which can be electrically connected to external engine diagnostics equipment, not shown. The spark sensor 16 is made up of a thin flat layer 20, made of conductive material, sandwiched between two flat plates, an upper insulating plate 22, and a lower insulating plate 24. The plates 22, 24 can be held together by fasteners, glue or other suitable means. The width of the insulating plates 22, 24 are greater than the width of the conductive layer 20 and overlap it on all sides, but are limited in width by the distance between the ignition coil towers 12 on the coil pack 10 since the spark sensor 16 must be able to slide in and out between the ignition coil towers 12. The thin flat layer 20 should also be relatively equally spaced between the pairs of ignition coil towers 12. The length of the conductive layer 20 is sufficient to allow conductive material to be positioned between each pair of ignition coil towers 12 when the spark sensor 16 is fully inserted within the coil pack 10.

Near the trailing edge 26 of the conductive layer, the upper insulating plate 22 has a hole 28 through which an electrical connector pin 30 can pass and come into contact with the conductive layer 20. The electrical connector 32, housing the pin 30, may be fixed to the board using screws, glue or other common methods of attachment. Electrical sensor lead 18 then connects to the electrical connector 32. Located at the spark sensor trailing edge 34 is a handle 36, giving a technician a place to grip the sensor when inserting it. In this embodiment, the handle 36 is a slotted acrylic ball cemented to the insulating plates 22, 24. At the leading edge of the spark sensor 16, the insulating plates 22, 24 may by tapered for ease of insertion into the coil pack 10.

An alternative embodiment is shown in FIG. 3, wherein the spark sensor 16 is fixed to the coil pack 10, or alternatively, the spark sensor 17 is packaged within the coil pack 10 itself between pairs of ignition coil secondary outputs 38. The spark sensor 17 will then have an electrical connector 33 protruding from the coil pack 10 which functions the same as the electrical connector 32 on the removable spark sensor 16. This embodiment provides for continuous on-board capability to determine cylinder identification in engines which require such information, such as engines utilizing sequential fuel injection. In either embodiment, therefore, a conductor is provided adjacent to and substantially equidistant from pairs of ignition coils, as shown in step 80 of FIG. 8.

In further alternative embodiments, the spark sensor is shaped to slide around the outside of the ignition coil towers, or a fixed sensor will provide a direct wiretap into the center of the secondary coil rather than capacitive coupling. Both of these configurations will produce the analog induced voltage difference signal 100, used to determine cylinder identification.

Figure 4:
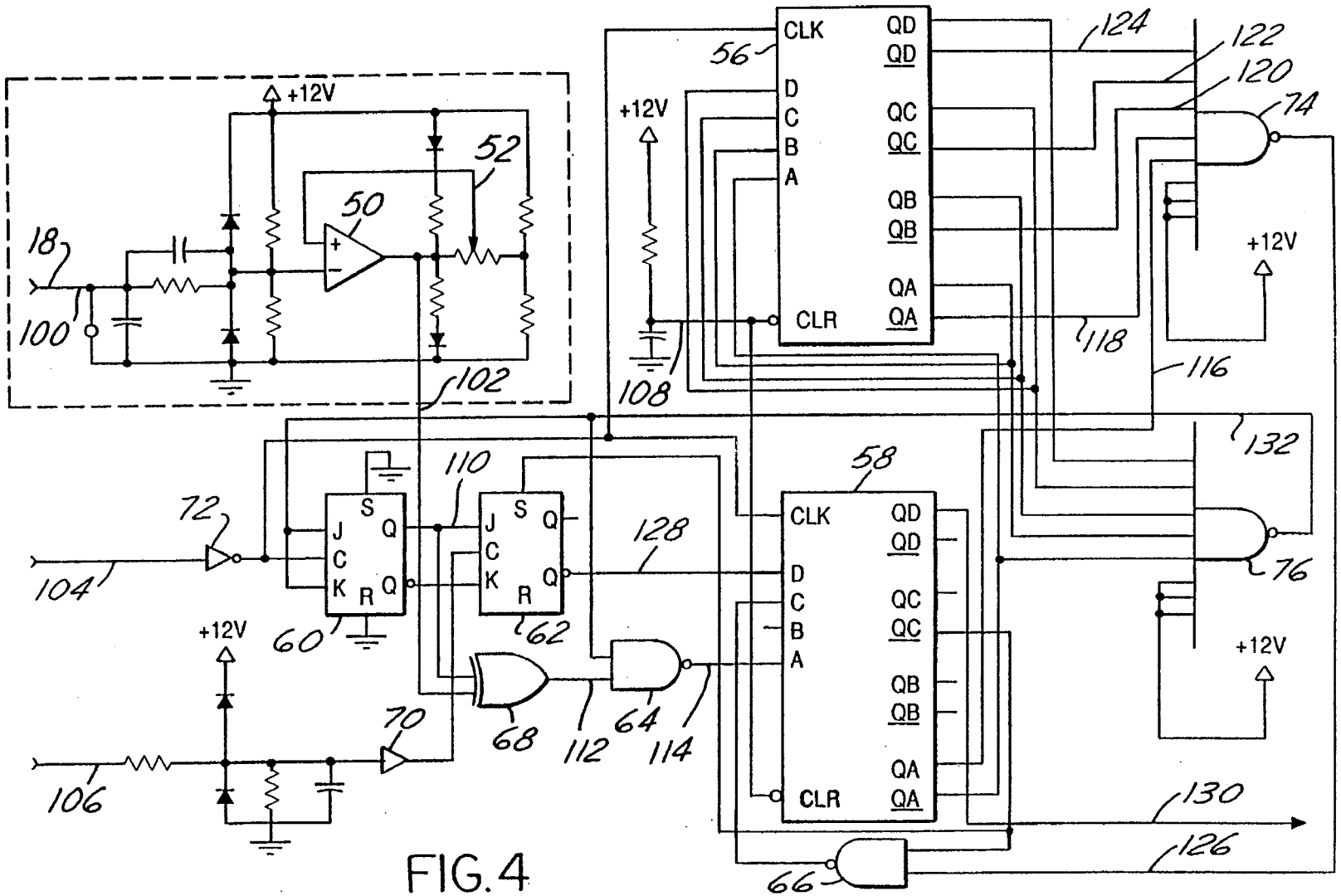
FIG. 4 is a circuit diagram showing the components used to convert the analog voltage drop differences into a digital signal and create the synthetic CID output, in accordance with the present invention.
Figure 8:
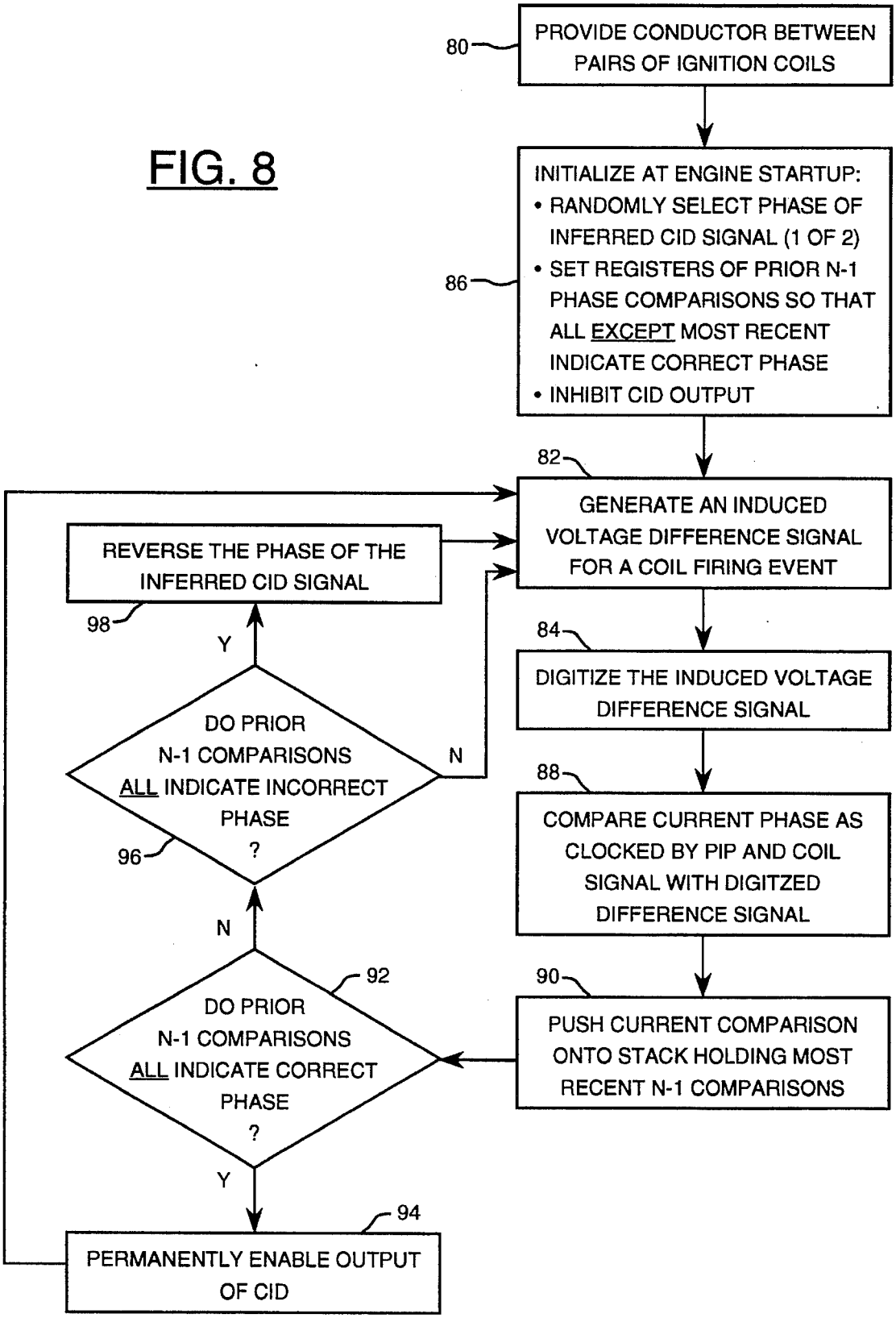
FIG. 8 is a flow diagram showing the steps taken to generate a synthetic cylinder identification signal, in accordance with the present invention.

When a coil firing event occurs, the spark sensor generates an induced voltage difference signal 100, as shown by process step 82 in FIG. 8. FIG. 4 shows the circuit into which the induced voltage difference signal 100 is sent for any of the embodiments discussed above. The induced voltage difference signal 100 produced by the spark sensor 16, or the permanently mounted spark sensor 17 in the alternative embodiment, is transmitted via the sensor lead 18 to a single op-amp comparator 50 which switches alternatively on the positive and negative voltage spikes of the voltage difference signal 100, thereby accomplishing the function of a polarity detector. The comparator 50 also includes a potentiometer 52 for adjustable hysteresis, in order to eliminate most of the noise from the induced voltage difference signal 100. The resulting signal from the comparator 50 is a digital voltage difference signal 102, which is a square wave switching on the alternative voltage spikes of the voltage difference signal 100, as shown in FIGS. 5 and 6, and shown by process step 84 in FIG. 8.

The main analyzing circuit, shown in FIG. 4, requires three inputs. These are the digital voltage difference signal 102 from the comparator 50; the profile ignition pickup (PIP) signal 104, which can be obtained at a connector to the EDIS microprocessor module (not shown) and is produced from a crankshaft sensor (not shown); and a primary coil signal 106, which can also be obtained at a connector to the EDIS microprocessor and is also produced based on the crankshaft sensor. For the first alternative embodiment, the primary coil signal 106 could also be obtained at the circuit driving the firing of the coils instead of using the connector to the EDIS microprocessor. The PIP signal 104 rises on every firing of a coil, which is typically 10 degrees before top dead center of a cylinder, thereby providing the clocking for the circuit. The primary coil signal 106 is used to determine which pair of plugs is firing when the PIP signal 104 rises.

The main analyzing circuit 54 utilizes a pair of J–K flip-flops 60 (FF1), 62 (FF2), two quad "D" flip-flops 56 (FF3), 58 (FF4) with a common clock, two 2-input NAND gates 64, 66, a single XOR gate 68, one non-inverting input buffer 70, one inverting input buffer 72, and two 8-input NAND gates 74, 76. All flip-flops 56, 58, 60, 62 trigger on the rising edge of the signal input to the clock pin. The second flip-flop 62 clock signal is derived from the primary coil signal 106, while all other clock signals are derived from the PIP signal 104 after it has been inverted by the input buffer 72.

Figure 5:
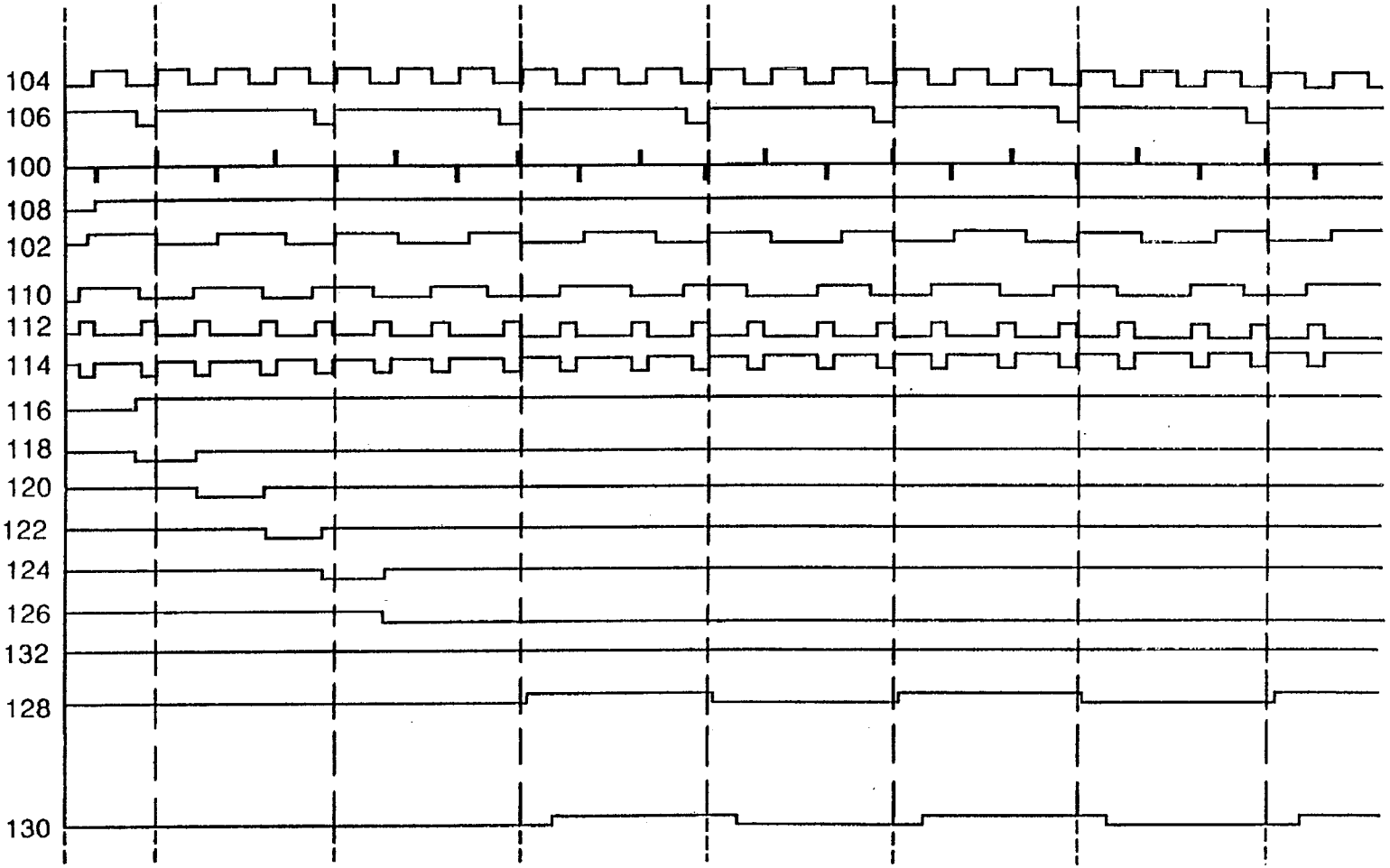
FIG. 5 is a graphical .representation of signal sampling of various control signals generated by the embodiment shown in FIG. 4 when the random guess of the engine phase is correct, in accordance with the present invention.

The operation of the circuit 54 is shown by the timing diagrams in FIGS. 5 and 6 and the flow diagram of FIG. 8. Two possible engine phases exist, i.e., either a particular cylinder is in its power stroke or its wasted stroke. Therefore one of the primary functions of this circuit is to determine which half of its cycle the engine is in. The initial phase of the first flip-flop 60 produces a random initial guess as to the correct engine phase, process step 86. FIG. 5 shows the logic of the circuit when the initial random guess of the engine phase is correct, while FIG. 6 shows the logic of the circuit when the initial random guess of the engine phase is incorrect.

Upon power-up, a clear signal 108 initializes the third and fourth flip-flops 56, 58 to zero for all outputs. For each firing of a coil, an exclusive or comparison is made by XOR 68 between the digital voltage difference signal 102 and the Q output signal 110 of the first flip-flop 60, process step 88. The XOR output signal 112 is then passed through the NAND 64, producing an NAND signal 114, and strobed to the QA output, producing the QA signal 116 of the fourth flip-flop 58 on the falling edge of the PIP signal 104. Since, for this initial random guess, the states of the Q output signal 110 and the digital voltage drop signal 102 agree, at each falling PIP signal 104, the output of the QA Signal 116 of fourth flip-flop 58 is kept high after every firing. Also, the output of QA of fourth flip-flop 58 is input to the third flip-flop 56, which is wired as a shift register. The underline symbol associated with outputs is used herein to indicate a logic inversion.

The third flip-flop 56 will then effectively store the last four outputs from QA of the fourth flip-flop 58 as this data is clocked through the subsequent registers, process step 90. The four output signals 118, 120, 122, 124 from the third flip-flop 56, along with the current output from QA 116 of the fourth flip-flop 58, represent the last five output signals 114 from NAND 64. Therefore, when all five of these signals agree that the digital voltage difference signal 102 was properly synchronized with the Q output signal 110 from the first flip-flop 60, process step 92, an all agree signal 126 from the NAND 74 goes low and releases the second flip-flop 62 producing a Q signal 128, thereby allowing the synthetic CID signal 130 to become active, process step 94. The use of five signals in a six cylinder engine is chosen to allow for the proper determination of the synthetic CID even though one of the six spark plugs in the engine may be fouled and thus always produces a voltage difference signal of the same net polarity regardless of which cylinder of the pair is in its power stroke. For the same reason, this system will also produce synthetic CID even if one of the three coils fails.

A difference between a true CID signal produced with camshaft driven sensors and the synthetic one produced here is that the former has transitions occurring at exact angular positions within the cycle, whereas the synthetic signal transitions not at any particular PIP edge. This, nevertheless, is of no real consequence since exact angular position information can be obtained directly from the PIP signal, and synthetic CID is only needed to distinguish which half of the engine cycle the engine is in.

FIG. 6 shows the timing diagram when the initial random guess as to engine phase is wrong, as shown by Q signal 110 output from the first flip-flop 60. As stated earlier, the third and fourth flip-flops 56, 58 are initialized to zero. Since, for the initial guess, the states of the Q output signal 110, from the first flip-flop 60, and the digital voltage drop signal 102 disagree at each falling PIP signal 104, the output of the QA signal 116 of fourth flip-flop 58 is kept high after every firing. When the system reaches a state in which signals 116–124 indicate low, the inverse of these signals, which all are input into the NAND 76, read high and thereby produce a resulting all disagree signal 132, process step 96. This signal 132 is then input into the first flip-flop 60, which causes the Q signal 110 to be phase shifted relative to the digital voltage drop signal 102, process step 98. The circuit 54 then behaves as shown in FIG. 5, where the random guess of the engine phase is correct.

The circuit 54 is designed to allow for production of a synthetic CID signal 130, once it begins to be produced, even if the spark sensor 16 deviates from the regular pattern shown in FIGS. 5 and 6. This is true because the synthetic CID signal 130 results simply from the switching of the second flip-flop 62 by the primary coil signal 106 as a result of the sampling of the output of the first flip-flop 60 which is switched on the falling edges of the PIP signal 104.

Also of note in regard to this circuit is that if the signals produced from the spark sensor 16 are so erratic that the no five consecutive digital voltage difference signals 102 are produced that agree with the Q signal 110, then no all agree signal 126 is ever produced, and consequently no synthetic CID 130 will be produced either. Therefore, no synthetic CID signal 130 will be produced if either the initial random guess was wrong and has not yet been corrected over five intervals or no consistent voltage difference signal is produced because more than one plug or coil is fouled.

A further alternative embodiment involves programming an existing on board microprocessor to accomplish the functions of the electrical circuit, basing the program on the flow diagram shown in FIG. 8.

While the best mode for carry out this invention has been described in detail, those familiar with the art to which this invention relates will recognize various alternative designs and embodiments for practicing the invention, including its application to engines with various numbers of cylinders. Accordingly, it is intended that the scope of the invention be limited only by the following claims.

We claim:

1. A method of identifying a power stroke of individual cylinders in a multi-cylinder four cycle engine with a wasted spark electronic distributorless ignition system having at least two ignition coils each coupled to two different spark plugs, such engine sensing the angular location of a crankshaft based on a crankshaft sensor used in producing a profile ignition pickup (PIP) signal and primary coil signal but lacking a camshaft driven cylinder identification sensor, the method comprising the steps of:

providing a conductor adjacent to and substantially equidistant to each pair of secondary coil outputs of the ignition coils, to generate an induced voltage difference signal during each coil firing event; and analyzing the induced voltage difference signals, the PIP signal and the primary coil signal to determine which cylinder, associated with one of the pairs of fired spark plugs, is entering its power stroke.

2. The method of claim 1 wherein the analyzing step further comprises, generating a synthetic cylinder identification signal if at least a majority of the last N induced voltage difference signals give consistent results, where N is the number of cylinders in the engine, thereby obtaining the power stroke identification even if one of the coils or spark plugs fail.

3. The method of claim 1 wherein the analyzing step further comprises, generating a synthetic cylinder identification signal only if all of the last N-1 induced voltage difference signals give consistent results, where N is the number of cylinders in the engine, thereby obtaining the power stroke identification even if one of the spark plugs or one of the coils fails.

4. The method of claim 1 wherein the correlating step is comprised of:

digitally indicating the polarity of the induced voltage difference signal using a comparator, thereby eliminating noise and producing a digital voltage difference signal;

randomly selecting one of two possible engine phases and producing an engine phase signal based on the crankshaft location as determined from the PIP signal and the primary coil signal;

comparing the randomly selected engine phase signal with the digital voltage difference signal for each coil firing event, thereby determining if the correct engine phase was randomly chosen for that firing event;

storing the results from the comparison for the previous N-1 firing events, where N is the number of cylinders in the engine;

determining if all of the last N-1 firing events give consistent results and agree with the randomly selected engine phase and thereby transmitting a resulting all agree signal if all of the last N-1 voltage drops give consistent results;

determining if all of the last N-1 firing events give consistent results and disagree with the randomly selected engine phase and thereby transmitting a resulting all disagree signal which reverses the randomly selected engine phase signal; and generating a synthetic cylinder identification signal.

5. The method of claim 4 wherein no signal is produced if more than one of the last N-1 firing events have always given inconsistent results, which results in no synthetic cylinder identification signal being produced.

6. An apparatus for identifying a power stroke of individual cylinders in a multi-cylinder four cycle engine with a wasted spark electronic distributorless ignition system, having pairs of spark plugs which share a common ground and ignition coil, and a crankshaft sensor producing a profile ignition-pickup (PIP) signal and primary coil signal, said engine lacking a camshaft driven cylinder identification sensor, the apparatus comprising:

a spark sensor, adapted to be placed adjacent to and substantially equidistant from pairs of ignition coil secondary outputs to produce an induced voltage difference signal during each coil firing event; and a microprocessor, electrically connected to the spark sensor and the crankshaft sensor, the microprocessor including a means for evaluating the induced voltage difference signal, the PIP signal and the primary coil signal, to generate a synthetic cylinder identification signal identifying when a predetermined cylinder is beginning its power stroke.

7. The apparatus of claim 6 wherein the microprocessor is comprised of:

comparator means for digitally indicating the polarity of the induced voltage difference signal, thereby eliminating noise and producing a digital voltage difference signal; and analyzing means for analyzing the last digital voltage difference signal corresponding to each cylinder firing event and generating a synthetic cylinder identification signal only if all of the last N-1 digital voltage difference signals give consistent results and agree with a randomly selected engine phase, where N is the number of cylinders in the engine.

8. The apparatus of claim 7 wherein the analyzing means is comprised of:

random selection means for randomly selecting one of two possible engine phases and producing a phase signal based on the location of a crankshaft as determined from the PIP signal and the primary coil signal;

comparison means for comparing the randomly selected engine phase with the digital voltage difference signal for each coil firing event, thereby determining if the correct engine phase was randomly chosen for that firing event;

storage means for storing the results from the comparison means for the last N-1 firing events, where N is the number of cylinders in the engine;

voting means for determining if all of the last N-1 voltage drops give consistent results and agree with the randomly selected engine phase and transmitting a resulting all agree signal if in fact all of the last N-1 voltage drops give consistent results;

second voting means for determining if all of the last N-1 voltage drops give consistent results and disagree with the randomly selected engine phase wherein an all disagree signal is produced which reverses the randomly selected engine phase; and means for generating a synthetic cylinder identification signal.

9. The apparatus of claim 8 wherein the spark sensor comprises a flat plate, made of an electrically conducting material sandwiched between two layers of insulating material, which has a width adapted to slide the coil sensor between the ignition coil towers, and a length sufficient to allow a portion of the flat plate to extend between all of the pairs of ignition coil towers of the coil pack when installed, thereby providing the capability to capacitively sense the voltage drop difference for all of the pairs of spark plugs with one sensor.

10. The apparatus of claim 6 wherein the spark sensor comprises a flat plate, made of an electrically conducting material sandwiched between two layers of insulating material, which has a width adapted to slide the spark sensor between spaced apart pairs of ignition coil towers, and a length sufficient to allow a portion of the flat plate to extend between all of the pairs of ignition coil towers of a coil pack when installed, thereby providing an induced voltage difference signal for all of the pairs of spark plugs with one sensor.

11. The apparatus of claim 6 wherein the spark sensor comprises a flat plate made of an electrically conducting material mounted within in a coil pack between pairs of spaced apart ignition coil towers, with a length sufficient to allow a portion of the flat plate to extend between all of the pairs of ignition coil towers of a coil pack, thereby providing an induced voltage difference signal for all of the pairs of spark plugs with one sensor.

12. The apparatus of claim 6 wherein the spark sensor is placed between and equally spaced from each of the ignition coil secondary outputs.

13. An apparatus for identifying the polarity of the net voltage spike representing the difference in the magnitude of voltage spikes for a given firing event of a particular pair of cylinders sharing a common coil in a multi-cylinder four cycle engine with a wasted spark electronic distributorless ignition system, having pairs of spark plugs which share a common ground and ignition coil, and a plurality of ignition coils forming a coil pack, the apparatus comprising:

a spark sensor, adapted to be removably placed in the coil pack adjacent to and substantially equidistant from ignition coil towers on the coil pack, the spark sensor producing an induced voltage difference signal due to a voltage drop differences between spark plugs sharing the same coil.

14. The apparatus of claim 13 wherein the spark sensor comprises a flat plate, made of an electrically conducting material, which has a width adapted to slide between the ignition coil towers, and a length sufficient to allow a portion of the flat plate to extend between all of the pairs of ignition coil towers of the coil pack, thereby providing an induced voltage difference signal for all of the spark plug pairs.

15. The apparatus of claim 14 wherein the flat plate is sandwiched between two layers of insulating material.

16. The apparatus of claim 13 wherein the spark sensor further comprises an electrical connector mounted to the flat plate for transmitting the induced voltage difference signal.

17. A coil pack for use in a multi-cylinder four cycle engine with a wasted spark electronic distributorless ignition system, having pairs of spark plugs which share a common ground and ignition coil within a coil pack, the coil pack characterized by:

a spark sensor permanently mounted within the coil pack adjacent to and spaced substantially equidistant from pairs of ignition coil secondary outputs, the spark sensor having an output for providing an induced voltage difference signal due to voltage drop differences between spark plugs sharing the same coil indicative of which spark plug is in a cylinder having a power stroke.

18. The coil pack of claim 17 wherein the spark sensor comprises a flat plate, made of an electrically conducting material, which has a width adapted to fit between the pairs of ignition coil secondary outputs and a length sufficient to allow a portion of the flat plate to extend between all of the pairs of ignition coil secondary outputs, to provide the capability to detect the voltage drop difference for all of the spark plug pairs.

19. The coil pack of claim 17 wherein the spark sensor comprises a center tap electrically connected to the center of each of the secondary coils, to provide the capability to detect the voltage drop difference for all of the spark plug pairs.

* * * * *